United States Patent [19]

Symbold

[11] Patent Number: 4,611,451

[45] Date of Patent: Sep. 16, 1986

[54] SIMULATED THATCH ROOF SHINGLES

[76] Inventor: John Symbold, 2323 Dixie Belle Ave., Orlando, Fla. 32806

[21] Appl. No.: 622,967

[22] Filed: Jun. 21, 1984

[51] Int. Cl.[4] ..... E04D 1/00

[52] U.S. Cl. ..... 52/555; 52/750

[58] Field of Search ..... 52/750, 555, 557, 559, 52/518, 546

[56] References Cited

U.S. PATENT DOCUMENTS

| | | | |
|---|---|---|---|
| 614,478 | 11/1898 | Johnston | 52/750 |
| 1,492,609 | 5/1924 | Simpson | 52/557 X |
| 1,492,610 | 5/1924 | Simpson | 52/750 X |
| 2,171,010 | 8/1939 | Schuetz et al. | 52/555 |
| 3,703,062 | 11/1972 | Mckinney | 52/546 X |
| 4,140,825 | 2/1979 | Koschorrek | 52/750 X |

FOREIGN PATENT DOCUMENTS

| | | | |
|---|---|---|---|
| 1002620 | 8/1965 | United Kingdom | 52/750 |

*Primary Examiner*—Carl D. Friedman

*Attorney, Agent, or Firm*—Macdonald J. Wiggins

[57] ABSTRACT

A shingle formed from a sheet of thin metal such as aluminum having a narrow border portion and a plurality of strips of various lengths depending from the border. The shingles are attached to a roof by nailing through the border portion such that the strips overlap the border portions of adjacent shingles thereby producing a simulation of a natural thatched roof.

6 Claims, 4 Drawing Figures

SIMULATED THATCH ROOF SHINGLES

BACKGROUND OF THE INVENTION

1. Field of the Invention

The present invention relates to roofing material, and more particularly, to a simulated thatched roofing and method of making the same.

2. Description of the Prior Art

Thatched roofs are widely used in subtropical regions of the world for many types of structures. Such roofs are used in the United States predominately for decorative purposes, such as entertainment and tourist establishments, zoos, and museums. When conventional thatch materials are used, for example, shredded bamboo, straw, grass, or other vegetable materials, the life expectancy of the roof when exposed to temperate zone weather conditions is quite short. The expense of frequent replacement is therefore high.

There is a need for an artificial thatched roofing material that will produce the desired tropical appearance, that is relatively inexpensive, and that will have a long, useful life. In the prior art, U.S. Pat. No. 233,269 to McClelland, teaches thatched roofing, but suggests straw as a basic material. Johnston in U.S. Pat. No. 614,478 also discloses straw roof construction. Artificial thatching is mentioned in U.S. Pat. No. 1,492,610 to Simpson, formed from material such as wooden rods, wire, and metal tubes. Simpson is concerned basically with waterproofing by using a conventional shingle having a fringe of the simulated thatch such that the shingle portions overlap.

SUMMARY OF THE INVENTION

My invention provides a durable and attractive roofing which has the appearance of natural straw or vegetable fiber thatching, yet will have an almost unlimited life. The roofing is formed from shingle elements having any convenient dimensions. Each element is preferably formed from thin anodized or painted aluminum sheet. A typical size may be 12" by 24". A border along one long edge of the element is provided having punched holes for nailing. The other long edge is shredded to provide a multiplicity of thin, essentially parallel strips and spaces extending to the border. The ends of the strips are trimmed to various lengths to produce a random appearance.

I have found that the use of a simple and low cost stamping die is ideal for producing the strips and may be adapted to cause each strip to be creased longitudinally. The result is a shingle having a multiplicity of thatch-like strips attached to a narrow border.

The shingles are attached to conventional sloping roof decking overlapping in the same fashion as asphalt type shingles, such that the border areas are covered by the thatch-like strips. As may be understood, the result is a roof surface having an appearance of a natural thatched roof. The painted aluminum may be obtained in various earthtone colors and mixing shingles of differing tints and shades produces a realistic appearance.

It is, therefore, a principal object of my invention to provide an artificial thatched roof material and a method of making the same.

It is another object of my invention to provide shingles stamped from thin metal having an upper border and a multiplicity of parallel strips and spaces of various lengths attached to the borders.

It is still another object of my invention to install shingles of the invention in an overlapping pattern to form the appearance of a natural thatched roof.

These and other objects and advantages of my invention will become apparent from the following detailed description when read in conjunction with the drawings.

DETAILED DESCRIPTION OF THE PREFERRED EMBODIMENT

Figure 1:
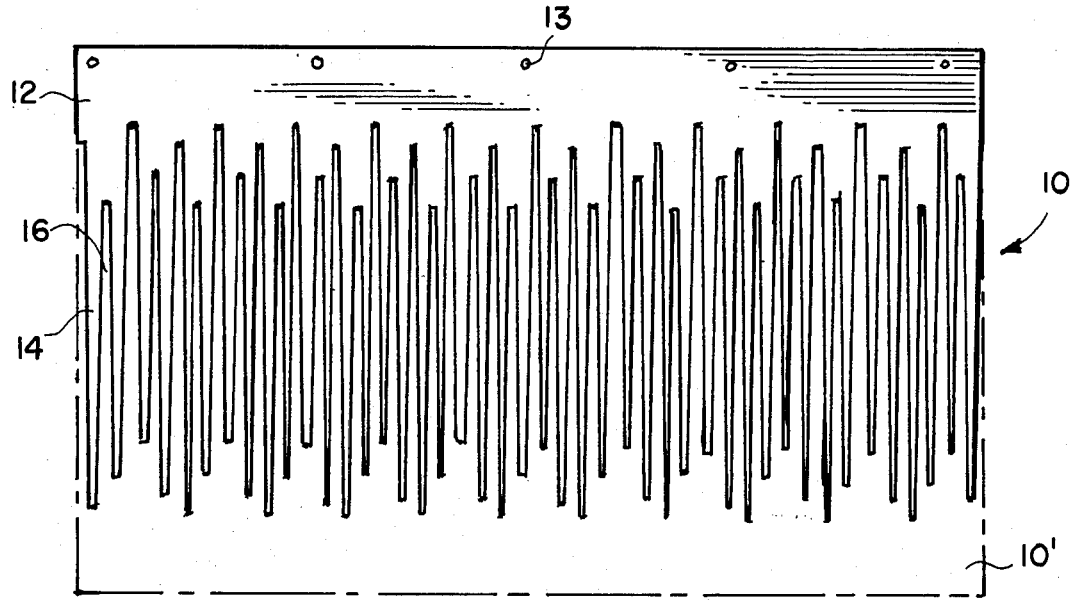
FIG. 1 is a plan view of a typical shingle of my invention.

My simulated thatched roof is preferably formed from a plurality of shingles. A typical shingle 10 suitable for my invention is shown in plan view in FIG. 1. Although a variety of materials may be used, I prefer painted aluminum of about 0.019 inch thichness. Shingle 10 may be fabricated from sheet having dimensions of 12" by 24" or 36". A border 12 is provided along its upper edge. The lower edge is formed into a multiplicity of essentially parallel strips 14 having spaces 16 therebetween. As will be noted from FIG. 1, each strip 14 is slightly tapered from its attachment to border 12 to the ends thereof. This feature also produces complementary tapers of spaces 16 between strips 14. The lengths of strips 14 and the depths of spaces 16 are varied along shingle 10 so as to present a random appearance in the finished roof.

Figure 2:
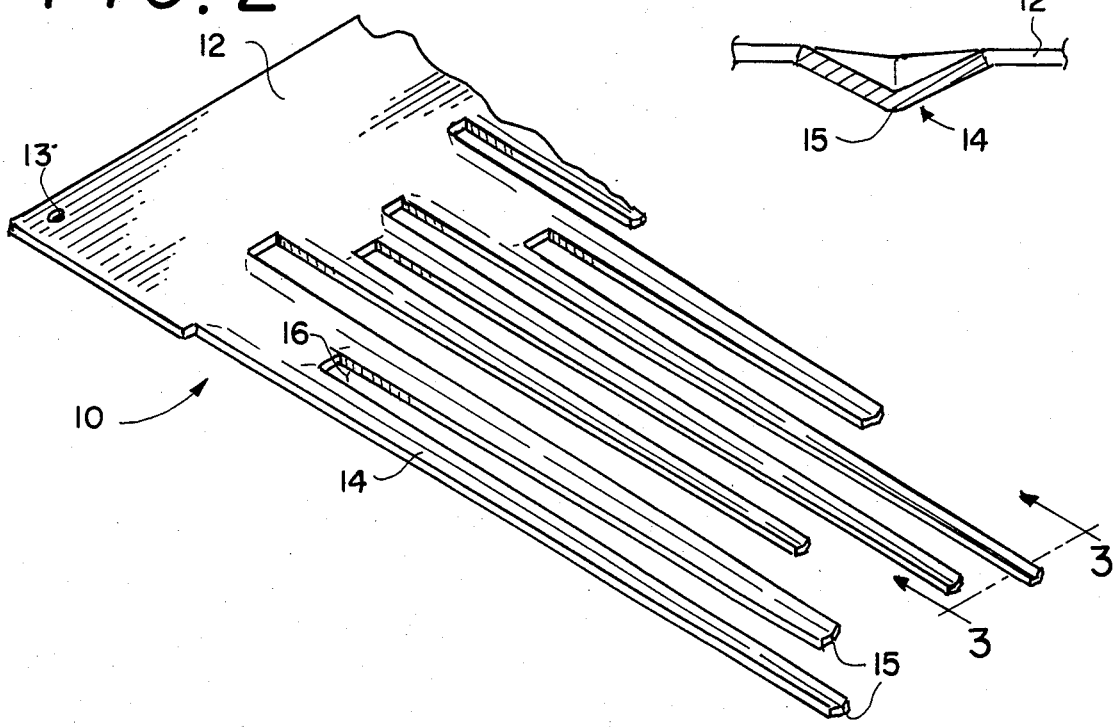
FIG. 2 is a perspective partial view of the shingle of FIG. 1 showing details thereof.
Figure 3:
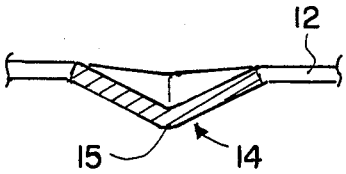
FIG. 3 is a cross-sectional view of one strip of the shingle of FIG. 1.

Although shingle 10 may be fabricated by any suitable process, I prefer to use a steel stamping die and to make spaces 16 complementary to strips 14. For example, by using a blank of about 14" by 24", a single stamping will produce two shingles as indicated by the dashed line shingle 10' in FIG. 1. As best shown in FIG. 2, the stamping operation produces a shallow longitudinal crease 15 in each strip. See the cross-sectional view of strip 14 in FIG. 3. Although not shown in FIG. 2, I have found that a random, slight curving or curling of strips 14 adds to the random appearance upon installation. This curling of strips 14 as will be noted from FIG. 4 automatically occurs during the stamping operation due to stresses in the material set up from the cutting and creasing. Advantageously, this characteristic assists in producing the desired thatch-like appearance of the finished roof.

The preferred sheet aluminum may be obtained in a variety of colors. By selecting earthtone colors, the completed roof will have the appearance of natural thatching. However, any desired color may be used for special stylized buildings.

Figure 4:
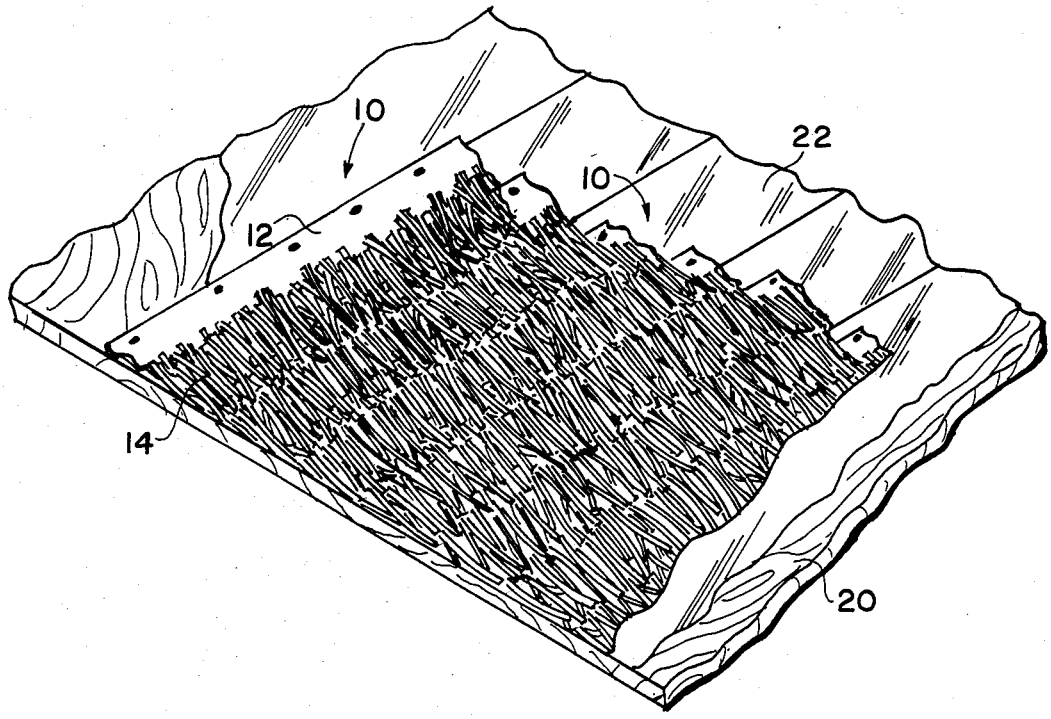
FIG. 4 is a partial view of a simulated thatched roof in accordance with my invention.

A typical roof construction in accordance with my invention is illustrated in FIG. 4. A wood roof surface 20 is covered with a waterproof material 22 such as mopped in roofing felt, roofing membrane, or the like. Shingles 10 are nailed in place with sufficient overlap for strips 14 to cover the border portion 12. Individual strips 14 may be given slight curves as the shingles are installed. When the roof is covered with shingles 10, a very realistic thatched roof results which may be expected to last for the life of the structure.

As may now be understood, I have disclosed the method of making a simulated thatched roof including the steps of stamping out shingles having a multiplicity of thin strips of various lengths having spaces therebetween; covering a roof with an underlayment; nailing the shingles to overlap such that the strips and spaces will have the appearance of natural thatching; and randomly curling some of the strips.

Although I have disclosed the use of aluminum as a material, it is to be understood that other materials such as galvanized steel or weather resistant plastics may be used. Variations in the widths and patterns of the strips will be obvious to those of skill in the art. All such modifications are considered to fall within the scope and spirit of the invention.

I claim:

1. A simulated thatched roof for a structure having a roof surface and a waterproof covering disposed over said roof surface; and overlapping one-piece unitary shingles attached to said roof surface and overlaying said covering, each of said strips having a slight taper from its proximal end to its distal end and each of said shingles having an upper border portion contiguous with a plurality of depending narrow strips of various lengths, each of said strips separated from adjacent ones thereof by a space essentially complementary to the shapes of said strips and approximately equal in width to the width of said strips, each of said strips including a shallow longitudinal crease along at least a portion thereof, and a slight curling of the distal end thereof, said shingles disposed such that said strips of one shingle overlay said border portions of other shingles to thereby produce a simulation of a natural thatched roof.

2. A shingle as defined in claim 1 in which said shingles are attached to said roof surface by nailing through said border portions.

3. A shingle for a simulated thatched roof comprising:

a one-piece unitary member having a solid border portion; and a plurality of closely spaced narrow strips depending from said border, each of said strips having a slight taper from its proximal end to its distal end, each of said strips is separated from adjacent ones of said strips by a space complementary to the shapes of said strips and approximately equal in width to the width and shape of said strips, and each of said strips includes a shallow longitudinal crease along at least a portion thereof, and a slight curling of the distal end thereof.

4. A shingle as defined in claim 3 in which said member is formed from sheet aluminum.

5. A shingle as defined in claim 3 in which said member is formed from plastic sheet.

6. A shingle for a simulated thatched roof comprising:

a rectangular sheet having a solid border portion along one long edge thereof and a dependent portion along the other long edge thereof shredded to provide a multiplicity of narrow, essentially parallel strips with spaces between said strips, each of said strips having a slight taper from its proximal end to its distal end, each of said strips being separated from adjacent ones of said strips by a space approximately equal in width to the width and shape of said strips, each of said strips having a longitudinal crease therein and a slight curl thereto, the ends of said strips cut to various lengths for producing a random length appearance.

* * * * *